US010174466B2

(12) United States Patent
Pedretti

(10) Patent No.: US 10,174,466 B2
(45) Date of Patent: Jan. 8, 2019

(54) PNEUMATIC SUPPORT

(71) Applicant: Pibridge LTD, Lugano (CH)

(72) Inventor: Mauro Pedretti, Biasca (CH)

(73) Assignee: PiBRIDGE LTD, Lugano (CH)

( * ) Notice: Subject to any disclaimer, the term of this patent is extended or adjusted under 35 U.S.C. 154(b) by 0 days.

(21) Appl. No.: 15/312,990

(22) PCT Filed: May 21, 2015

(86) PCT No.: PCT/CH2015/000079
§ 371 (c)(1),
(2) Date: Jan. 26, 2017

(87) PCT Pub. No.: WO2015/176192
PCT Pub. Date: Nov. 26, 2015

(65) Prior Publication Data

US 2017/0130409 A1 May 11, 2017

(30) Foreign Application Priority Data

May 22, 2014 (CH) ..... 786/14

(51) Int. Cl.
*E01D 19/00* (2006.01)
*E04C 3/00* (2006.01)
(Continued)

(52) U.S. Cl.
CPC ..... *E01D 19/00* (2013.01); *E01D 6/00* (2013.01); *E01D 15/122* (2013.01); *E04C 3/005* (2013.01);
(Continued)

(58) Field of Classification Search
CPC ..... E01D 5/122; E01D 6/00; E01D 19/00; E04C 3/005; E04C 3/38; E04C 2003/0491; E04C 2003/0486
(Continued)

(56) References Cited

U.S. PATENT DOCUMENTS 2,636,457 A 4/1953 Finlay
4,676,032 A * 6/1987 Jutras ..... E04H 15/20 52/2.17
(Continued)

FOREIGN PATENT DOCUMENTS

CN 1823204 A 8/2006
CN 101476281 A 7/2009
(Continued)

OTHER PUBLICATIONS

Petrinja, Etiel, International Search Report for PCT/CH2015/000079 [6 pages].

*Primary Examiner* — Raymond W Addie
(74) *Attorney, Agent, or Firm* — Winstead PC

(57) ABSTRACT

A support structure including a tension-compression element is composed of tension-compression bars that are connected in real joints as well as tension straps that extend from one joint to another. The outermost tension-compression bars are connected in one respective knot. Two pressurized hollow members that are surrounded by a cover are arranged on both sides of a plane that extends through the tension-compression element such that the linear tensions σ generated in the cover preload the tension straps on the plane of the tension-compression element, secure the tension-compression bars against bending, and stabilize the joints. The linear tensioning components that extend perpendicular to said plane of symmetry strut the tension-compression element against lateral bending. Air-tight, optionally elastic pneumatic elements can be inserted into the hollow members.

16 Claims, 11 Drawing Sheets

(51) Int. Cl.

| | |
|---|---|
| ***E04C 3/38*** | (2006.01) |
| ***E01D 15/12*** | (2006.01) |
| ***E01D 6/00*** | (2006.01) |
| *E04C 3/04* | (2006.01) |

(52) U.S. Cl.
CPC ..... *E04C 3/38* (2013.01); *E04C 2003/0486* (2013.01); *E04C 2003/0491* (2013.01)

(58) Field of Classification Search
USPC ..... 14/2.6–15, 27–30
See application file for complete search history.

(56) References Cited

U.S. PATENT DOCUMENTS

| | | | | |
|---|---|---|---|---|
| 5,677,023 | A | 10/1997 | Brown | |
| 7,836,636 | B2 * | 11/2010 | Luchsinger | E04H 15/20 52/2.11 |
| 8,161,687 | B2 * | 4/2012 | Crettol | E04C 3/005 52/2.13 |
| 8,782,957 | B2 * | 7/2014 | Luchsinger | E04C 3/005 52/2.11 |
| 8,991,104 | B2 * | 3/2015 | Warner | E04C 3/005 52/2.11 |
| 2009/0282746 | A1 * | 11/2009 | Luchsinger | E04H 15/20 52/2.11 |
| 2013/0061536 | A1 | 3/2013 | Endo | |
| 2013/0145717 | A1 * | 6/2013 | Merrifield | B64G 1/22 52/646 |
| 2013/0291709 | A1 | 11/2013 | Woods et al. | |

FOREIGN PATENT DOCUMENTS

| | | | |
|---|---|---|---|
| JP | 2013023898 | A | 2/2013 |
| KR | 2013 0037283 | A | 4/2013 |
| WO | WO-01/73245 | A1 | 10/2001 |
| WO | WO-2005/007991 | A1 | 1/2005 |
| WO | WO-2005042880 | A1 | 5/2005 |
| WO | WO-2007071101 | A1 | 6/2007 |
| WO | WO-2007147270 | A1 | 12/2007 |

* cited by examiner

PNEUMATIC SUPPORT

TECHNICAL FIELD

The present invention relates to a pneumatic support.

BACKGROUND

Pneumatic supports of the type mentioned are known and based on a cylindrical basic shape according to WO 01/73245. This basic shape has been developed to create a spindle-shaped support according to WO 2005/007991. The advantage of such pneumatic supports is the low weight thereof as well as the exceptionally small transport volume, as the inflatable body can be folded up and the tension members can be constructed as ropes. One disadvantage of such pneumatic supports consists in the fact that although the pneumatic supports can support high loads per unit area (load distributed over the length of the support), the pneumatic supports are only suited to a limited extent for asymmetric loads compared to the possible load per unit area, particularly in relation to concentrated axial loads, which decisively hinders use as a bridge in particular, as an axle, of a lorry for example, rolling over a bridge constitutes a particularly unfavourable case in this regard.

The compression member is a substantial weak point, which as a slim rod is at risk of buckling, but cannot be constructed in a thicker manner, as otherwise the advantages of the pneumatic concept are minimized.

SUMMARY

FIG. 1 schematically shows a pneumatic, here spindle-shaped, support 1 according to the prior art, with exaggerated thickness for the sake of clarity. An inflatable body 2, which consists of a flexible material, at operating pressure keeps keeps a compression member 3 at an operative distance from a tension member 4, planking 5 in turn being indicated on the compression member 3 for the sake of clarity, which planking should make it possible to travel on the bridge formed by the support 1. The following concept can explain the functionality of the support:

If a load 6 acts on the planking 5 and therefore on the compression member 3, this is supported by the inflated body 2, which is at operating pressure, but for its part rests on the tension member 4, which therefore actually supports the load 6. As a result, the tension member 4 strives to yield downwards, but this is not possible as the compression member 3 keeps the common end nodes 7 and 8, therefore also the ends of the tension member 4 at a distance from one another. The regions in which the compression member 3 and the tension member 4 are operatively connected to one another are termed end nodes.

The result is that the tension member 4 is essentially only loaded with axial tension and the compression member 3 is essentially only loaded with axial pressure, so that the tension member 4 can be constructed as a rope and the compression member 3 can be constructed as a thin rod. However, a rod which is under pressure is at risk of buckling, with the consequence that the buckling limit of the compression member 3 determines the load ability of the support 1.

In the case of a load per unit area which acts in the direction of the arrow 6 and which is distributed symmetrically over the length of the support, as is the case for roof structures for example, there is a reduced risk of buckling, as buckling in one direction counter to the load action is reduced by the load itself, whilst in the load direction, buckling is reduced by the compression member 3 resting on the body 2.

However, in the case of an asymmetric load, the compression member sinks into the body 2 to a greater extent at the site of the load, and therefore warps upwards at a different point, with a tendency to warp outwards over the bearing surface on the body 2 and therefore to lift off from the same, which causes an increased risk of buckling and, relevant to that, reduced loadability of the support 1.

FIG. 2*a* shows an improved spindle-shaped support 10 according to WO 2005/042880, which is provided with vertically arranged (i.e. in the load direction and perpendicularly to the longitudinal axis of the support 10) connection elements, constructed as pure tension members 11. The distance a of the tension members 11 is to be optimized by the person skilled in the art with regards to the actual case.

The tension members 11 are suitable to a certain extent for preventing the compression member 3 from lifting off from the body 2 at a non-loaded location and therefore buckling in the case of an asymmetric load. The vertical tension members 11 only mean that the compression member and the tension member deform approximately equally (similar bending line), the vertical tension members are not suitable for reducing the size of the maximum flexion. However, a considerable loading (for example additional bending moments) is created in the compression member 3 at the location of a fastening point 12 for a tension member 11, which is in turn undesired.

FIG. 2*b* shows a possible arrangement of the tension members 11 in a support 10' according to WO 2005/042880, wherein a plurality of tension members 11 are arranged in a bundle-like manner at a distance from one another to be determined by the person skilled in the art and in a symmetrical arrangement with respect to one another, in each case starting from a common fastening point 13. This arrangement appears suitable to reduce the above-mentioned undesired loading in the compression member 3, as the action of the tension members 11 is distributed onto a small stretch opposite the fastening point 13. However, the reduction is only local.

The person skilled in the art will recognise from the disclosure of WO 2005/042880 that tension members 11 arranged at a distance a from one another advantageously increase the load-carrying capacity of the support 1 in the case of an asymmetric load, as the compression member 3 is at a reduced risk of buckling. (It may be added at this point that the tension member 4' in FIG. 2*b* is likewise constructed as a beam, thus the same could also carry a load 6' acting from below, wherein the compression member 3 would then be subject to a tensile load).

However, it is a disadvantage of the arrangement according to WO 2005/042880 that the pneumatic system is, as before, severely deformed under load. A tension member constructed as a rope (but also a tension member constructed as a long, thin rod) and the pneumatic body 2 in particular allow movements, which in the case of a load lead to a large deformation of the support in spite of sufficient loadability, if this is in the case of a load being it area and, to an increased extent, in the case of an asymmetrically acting load, for example in the case of a bridge which is being traveled on. Although the tension members 11 according to WO 2005/042880 suppress the tenancy of the compression member 3, 4' to buckle, this in turn lead to the tension member 4 lifting off locally, which in turn aids a deformation of the entire support 10' and ultimately again reduces the desired success with respect to buckling of the compression member 3. This deformation or flexion of the support 10, 10' represents a problem in the case of construction as a bridge in particular (also in the case of roofs, for example in the case of a storm), note least due to the risk of vibrations, as was the case for the flexible Millennium Bridge in London. In this case, it is self-evident that generally bridges or supports for accommodating loads are advantageously constructed to be as stiff as possible, as adjacent structures therefore do not have to be designed with respect to the corresponding movements, as is the case for example for the planking or carriageway of a bridge or the structures supported by a support. By contrast, as mentioned for the example of the Millennium Bridge, excessive softness of a support may lead to it not being usable, in spite of inherently satisfactory loadability for the intended purpose.

Accordingly, it is the object of the present invention to provide a pneumatic support with improved stiffness.

Because the connection element extends in a zigzag-shaped manner between the compression member and the tension member over a plurality of connection points in each case, pressure can be conducted into the tension member (although the connection elements are constructed as tension members), so that shear stresses between the compression member and the tension member can be absorbed, analogously to the shear stresses in the web of a double T girder. The arrangement according to the invention correspondingly stiffens a pneumatic support fivefold for example, or, in the case of the relevant asymmetric load, tenfold, as is shown below on the basis of a simulation calculation.

BRIEF DESCRIPTION OF THE DRAWINGS

The invention is explained in more detail on the basis of the figures.

In the figures.

DETAILED DESCRIPTION

Figure 3:
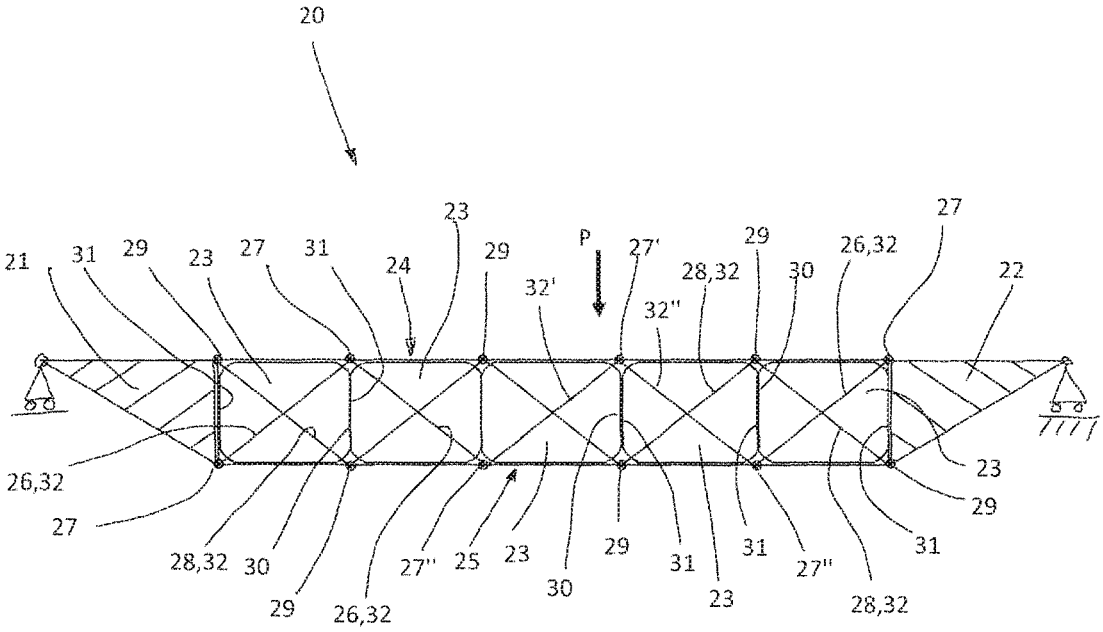

FIG. 3 schematically shows an embodiment of a support 20 according to the invention. End nodes 21, 22 enclose a number of pneumatic pressure bodies 23 between them and form an operative connection between the compression member 24 and the tension member 25, which rest on opposite sides on the pressure bodies 23, along the length thereof. At operating pressure, the pressure bodies 23 keep the compression member 24 and the tension member 25 at a distance from one another in an operative manner. The connection between the compression member 24 and the tension member 25 effected by the end nodes 21, 22 is such that the compressive forces acting in the compression member 24 can be introduced into the tension member 25, and also vice versa, and thus accommodated by the same.

A connection element 26 is fastened in an operative manner, by means of connection points 27, 27', 27" at a plurality of locations, on the compression member 24, on the tension member 25 and likewise on the end nodes 21, 22, such that the connection element extends in a zigzag-shaped manner over at least a plurality of connection points 27, 27', 27" of the compression member 24 and the tension member 25, in the embodiment gaplessly from the end node 21 up to the end node 22.

Likewise, in the preferred embodiment shown, a further connection element 28 runs over further connection points 29 in a zigzag-shaped manner through the support 20, preferably from the end node 21 up to the end node 22. The use of a plurality of connection elements 26, 28 results in lower distances between the corresponding connection points 27 to 27" and 29 on the respective compression member 24 of tension member 25, with the advantage that the buckling load of the compression member 24 is increased, as the length which is decisive therefor is given by the distance of the connection points 27, 29. Preferably, the connection elements 26 and 28 are arranged offset with respect to one another, as is shown in the figure, namely such that the connection points 27 to 27" and 29 assigned to the same are opposite one another in each case.

Figure 1:
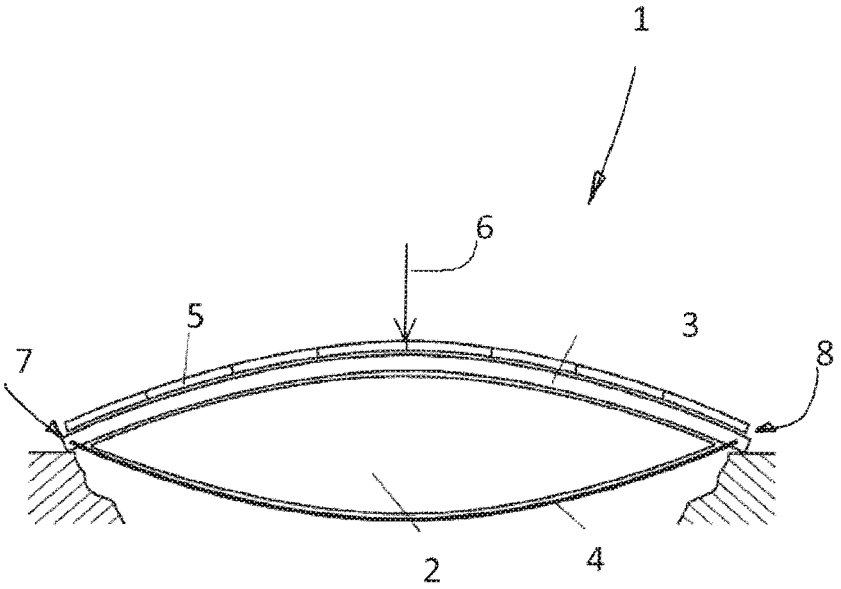
Fig 1 Prior Art
FIG. 1 schematically shows a spindle-shaped support according to the prior art, FIG. 2*a* schematically shows the support from FIG. 1 with vertical tension members, FIG. 2*b* schematically shows the arrangement of tension members according to the prior art in a section of a pneumatic support, FIG. 3 schematically shows an embodiment of the support according to the invention, FIGS. 4*a* and 4*b* schematically show further embodiments of a support according to the invention, consisting of modules, FIGS. 5*a* and 5*b* schematically show an embodiment for fastening the connection element on a compression member or on a tension member.
Figure 2A:
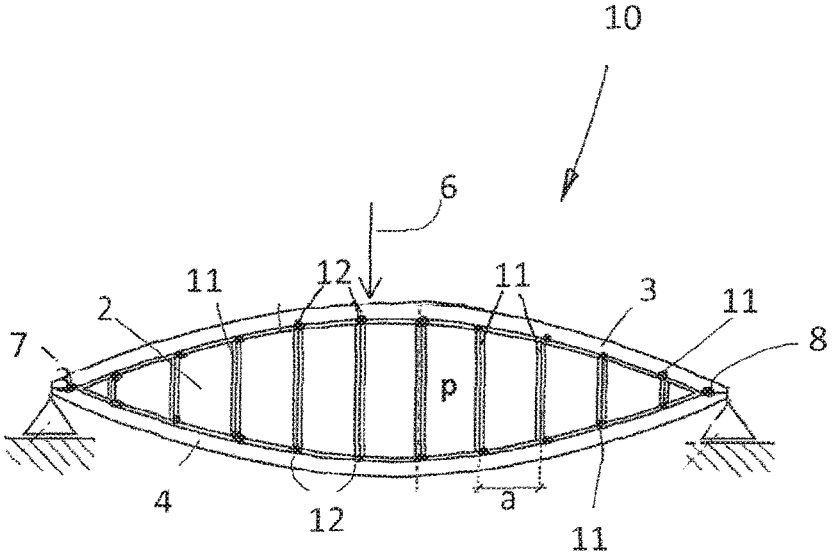
Fig 2a Prior Art
Figure 2B:
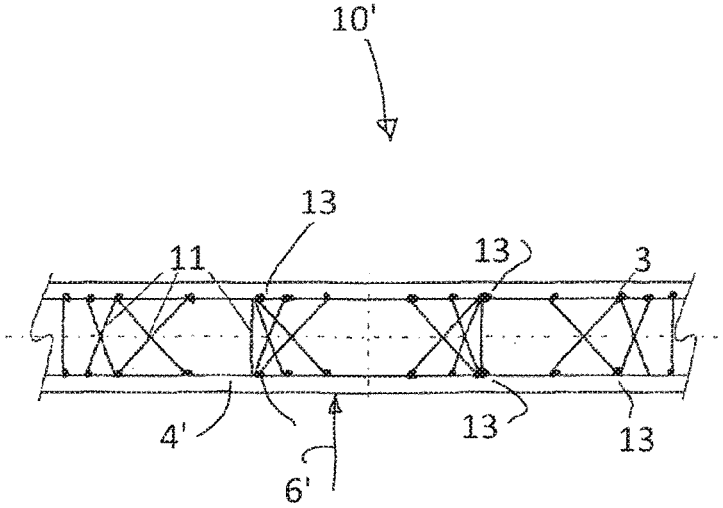
Fig 2b Prior Art

The end nodes 21, 22 are of stiff construction and supported on an external structure, such as the subsurface or on a different component. According to the figure, the end nodes are constructed to be so large in the embodiment shown that the height thereof corresponds to the height of the adjacent pneumatic pressure body 23. It is important and independent of the respective geometric construction of the end nodes that the end nodes connect the compression member 24 to the tension member 25 in such a manner that the same can introduce the compression or tension exerted through the same into the respective other member (tension member 25 or compression member 24). Accordingly, the end nodes can, as shown in the figures described below or also as shown in FIG. 1, be constructed to be smaller or constructed such that the tension member acts on the end of the compression member directly, for example. As a result, an end node is present if the compression member and the tension member are connected to one another directly or else via an arbitrarily geometrically constructed end element such that the compression acting in the compression member is introduced into the tension member and the tension acting in the tension member is introduced into the compression member, tension arising in the tension member and compression arising in the compression member as a result.

The compression member 24 transmits essentially axial pressure and is correspondingly constructed as a compression rod, whilst the tension member 25 transmits axial tension and can therefore be constructed in a flexible manner, for example as a rope. Of course, it is also possible to construct the tension member 25 as a rod, but such that the same can tolerate the tensile loading arising during operation. Thus, the tension member 25 can be constructed such that it can be loaded with pressure, so that the support 20 can also absorb load from below and can be loaded from both sides from above (load P) and also from below, in the opposite direction to load P.

Mutually adjacent pressure bodies 23 abut each other at operating pressure by way of the right and left faces 30, 31 thereof, so that the effect of a single pneumatic pressure body extending continuously from endnote 21 to end node 22 over a length results, which pressure body as such is likewise in accordance with the invention. The plurality of pressure bodies 23 shown in the figure can be mounted or unmounted and allow, as shown below, the support 20 to be assembled from a plurality of support modules, which can in turn have advantages for transport and storage. Furthermore, the pressure bodies 23 operatively keep the compression member 24 and the tension member 25 at a distance from one another in the rest state and in the case that a load P is acting on the support.

Pressure bodies of the type shown are known per se to the person skilled in the art, they can be constructed in a textile manner for example and provided with a gas-tight coating.

As mentioned, the connection element 26 runs in a zigzag-shaped manner through the length of the support 20, from connection point 27 to connection point 27 (or 27', 27") and, if there are further connection elements, for example the connection element 28, from connection point 29 to connection point 29. Preferably, a plurality of connection elements, which extend in a zigzag-shaped manner through the support, are therefore provided, wherein these connection elements each act at their own fastening points.

The connection element 26, 28 is pretensioned by the operating pressure in the pressure bodies 23 and is therefore a tension member and can be constructed in a correspondingly flexible manner, preferably as a rope. Furthermore, the connection element 26, 28 is preferably constructed as a continuous tension member (rope or chain, etc.). Likewise, it is however also in accordance with the invention that it consists of individual sections 32, which merely run from one connection point 27 (or 27', 27") or 29 (on the compression member 24 or on the tension member 25) to a different connection point 27 (or 27', 27") or 29 (on the tension member 25 or on the compression member 24). Then it is likewise in accordance with the invention to construct such sections 32 in a flexible manner for example, for example as a rope or as (tension) rods. The result is that the connection element 26, 28 can be divided into individual sections 32, which in each case extend from a fastening point 27, 29 on the compression member 24 to an associated fastening point 27, 29 on the tension member 25 (or vice versa).

The connection points 27, 29 are preferably constructed in such a manner that the connection element 26, 28 (or the individual sections 32 thereof) are directly fastened on the compression member 24 or on the tension member 25. However, it is also conceivable that the fastening takes place on the pressure body 23, because, as described in more detail in the following, the pretension in the connection element 26, 28 generated by the pressure bodies 23, which are at operating pressure, generates the effect according to the present invention.

Preferably, the connection points 27, 29 are constructed in such a manner that during operation, the longitudinal axes of the sections 32 or the corresponding sections of the continuously constructed connection elements 26, 28 essentially intersect in the region (preferably on the neutral axis) of the compression member 24 and the tension member 25. At least in the case of a tension member 25 constructed as a rope, this may not always apply exactly owing to tolerances and shifts in the mounted support 20, but is to be striven for, as otherwise the inherently achievable stiffness of the support 20 cannot be realized completely. Therefore, the longitudinal axes of two connection elements 26, 28 acting on the same connection point 27, 29 therefore intersect in the interior of the compression member and/or the tension member and particularly preferably on the neutral axis thereof.

If the pressure bodies 23 are at operating pressure, the connection element 26, 28 is pretensioned, as mentioned. Under the action of a load P acting at the location of the connection point 27' for example, this pretension is reduced at the location of the relevant connection point 27' in such a manner that only a correspondingly reduced tension is introduced into the opposite connection points 27". This in turn has the consequence that at the location of the connection points 27", the tension member 25 must absorb the forces generated by the internal pressure of the pressure bodies 23' to a greater extent, thus the axial tensile forces acting in the same are therefore increased.

This action is the same as if, via the sections 32', 32", pressure were to be introduced into the connection points 27"—the connection element 26 or the sections thereof 32', 32" are therefore ultimately compression struts constructed as tension elements, which absorb transverse forces acting in the support 20, i.e. the corresponding shear, so that the support 20 becomes stiff. The action of the connection element 26 for example corresponds to that of the web in the double T girder, which is considerably shear-loaded by means of a load and therefore lends the double T girder its stiffness.

The pneumatic supports according to the prior art cannot absorb this shear and are therefore flexible and show the corresponding deformations when loaded (cf. below for the FIGS. 9*a* to 9*c*, which show a comparison of the deformation of a support according to the invention with a support according to the prior art).

This also applies for the support according to WO 2007/071101, which has a flexible, longitudinal web: the web is vertically, but not horizontally pretensioned; no horizontal components of the pretension forces generated by the internal pressure in the web exist. Even if horizontal force components were to arise, the web would distort during the corresponding, oblique loading (direction of a section 32), with the consequence that the shear from the web cannot be absorbed. This is confirmed by the necessarily vertical and horizontal arrangement of the threads of the textile web shown: in the oblique direction, the web is completely flexible, as the square mesh formed by the threads would distort to a parallelogram-like mesh.

If, for the sake of simplicity, a volume element of the web is considered in more detail, still in our double T girder, the shear stresses generated by the transverse force lead to shearing at the volume element in the vertical direction. As the volume element remains in the state of equilibrium, shear stresses likewise act in the horizontal direction, with the consequence that the resultants of these shear forces lie in the diagonal of the volume element, which is inclined at 45° to the vertical or to the longitudinal axis of the support 20, perpendicularly to which the load P in turn acts.

Consequently, the sections 32 of the connection element 26, 28 are preferably inclined at an angle of 45° to the longitudinal axis of the support 20, as the shear absorbed by the transverse force is optimally absorbed and the support 20 is therefore maximally stiffened. In other words, it is the case that the sections 32 of the at least one connecting member 26 acting between two assigned fastening points 27', 27" are preferably inclined essentially by 45° with respect to the longitudinal axis of the support 20.

In the case of a load that does not act vertically, the person skilled in the art can correspondingly optimize the incline of the sections 32.

A full effect of the connection element 26, 28 requires the connection element to be constructed to be minimally flexible, that is hard, as is the case for thin wire ropes. Thus, the object according to the present invention can be fulfilled: as before, the inventive pneumatic support consists of parts which only have the minimum volume for transport or storage, hardly have any weight, but can absorb considerable even asymmetrically or punctiformly acting, by comparison exceptionally large loads with deformations reduced to 10% or even less—cf. the description for FIGS. 9*a* to 9*c* in this regard.

Therefore, generally a pneumatic support having a body which can be placed under pressure, for example can be inflated, which at operating pressure keeps a compression member, which extends substantially over the length thereof, and a tension member, which likewise extends substantially over the length thereof, at a distance from one another in an operative manner, connection points being provided on the compression member and on the tension member for at least one tensile connection element, which extends between the compression member and the tension member, and the connection element extending between the compression member and the tension member in a zigzag-shaped manner over a plurality of connection points in each case both in the region of the compression member and in the region of the tension member.

Preferably, the at least one connection element extends continuously through the support, over the entire length of the region that can be placed under pressure. If this is not the case, only a part region of the pneumatic support is stiffened according to the invention, so that for example an articulation created by a locally delimited flexible location results in the support, which may make sense if the same should be connected to a moving structure there. However, such an articulation is realized at a cost, due to properties of the entire support, which are no longer optimal, and is therefore only provided reluctantly by the person skilled in the art.

Furthermore, it can be seen from the embodiment illustrated in FIG. 3 that the fastening points 27, 27', 29 on the compression member 24 and those 29, 27" on the tension member 25 of the pneumatic support 20 have a distance and are offset with respect to one another by half of the distance in each case, such that the connection element 26, 28 extends along the inflatable body in a regular zigzag line.

Figure 4A:
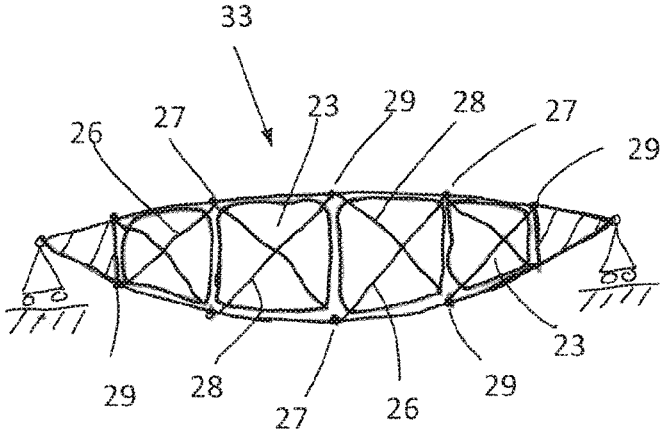
Figure 4B:
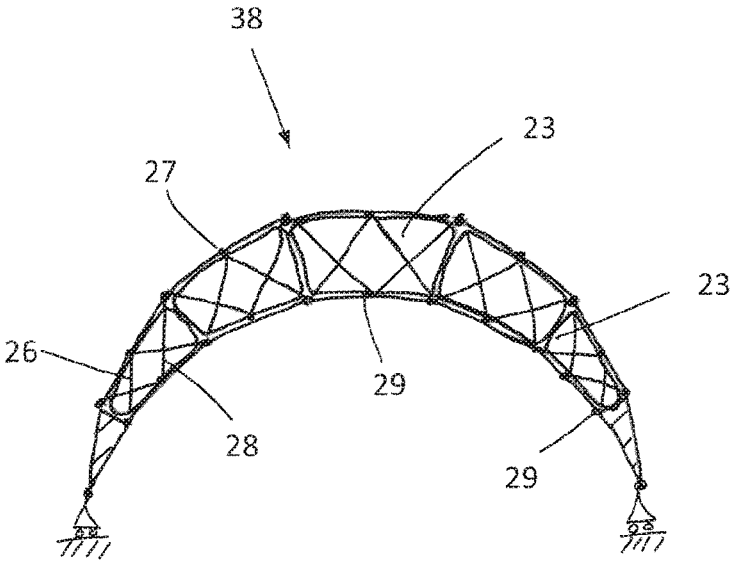

FIGS. 4*a* and 4*b* show embodiments of a support 33 (FIG. 4*a*) and 38 (FIG. 4*b*) schematically and modified in longitudinal section. The support 33 is constructed in a spindle-shaped manner. Thus, the diameter of the support 33 changes over the length thereof, with the consequence that the distance of the connection points 27, 29 of the connection elements 26, 28 likewise changes, in order to keep the same inclined at 45° to the longitudinal axis of the support 33. This is likewise the case for the support 38, which spans in an arcuate manner thanks to the curved longitudinal axis thereof and is correspondingly suitable for forming a roof for the area located beneath it.

Figure 5A:
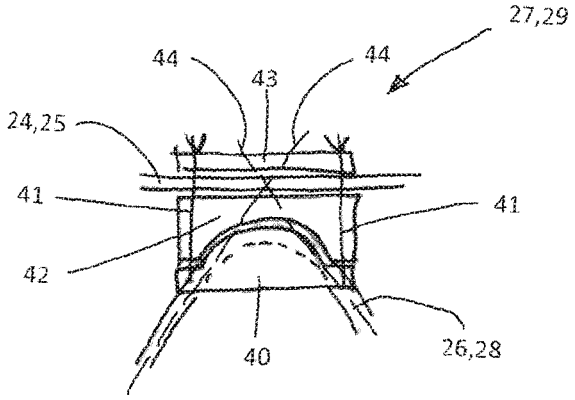
Figure 5B:
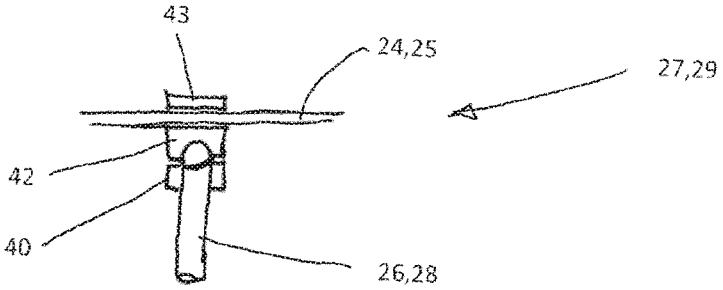

FIG. 5*a* shows a preferred design of a connection point 27, 29 for a continuously constructed connection element 26, 28 (FIG. 3). A counterpart piece 40 is connected to a base piece 42 with the aid of bolts 41, which are indicated by a line, and thus keeps the connection element 26, 28 in a fixed position. The longitudinal axes 44 thereof are indicated dashed, which, as mentioned above, intersect at the location of the compression member 24 (or tension member 25). The base piece 42 is in turn fixed in a gas-tight manner via a retaining plate 43 opposite the pressure body 23 (FIG. 3), which is omitted to make the figure clearer. FIG. 5*b* shows a cross section through the connection point 27, 28 of FIG. 5*a*.

Figure 6A:
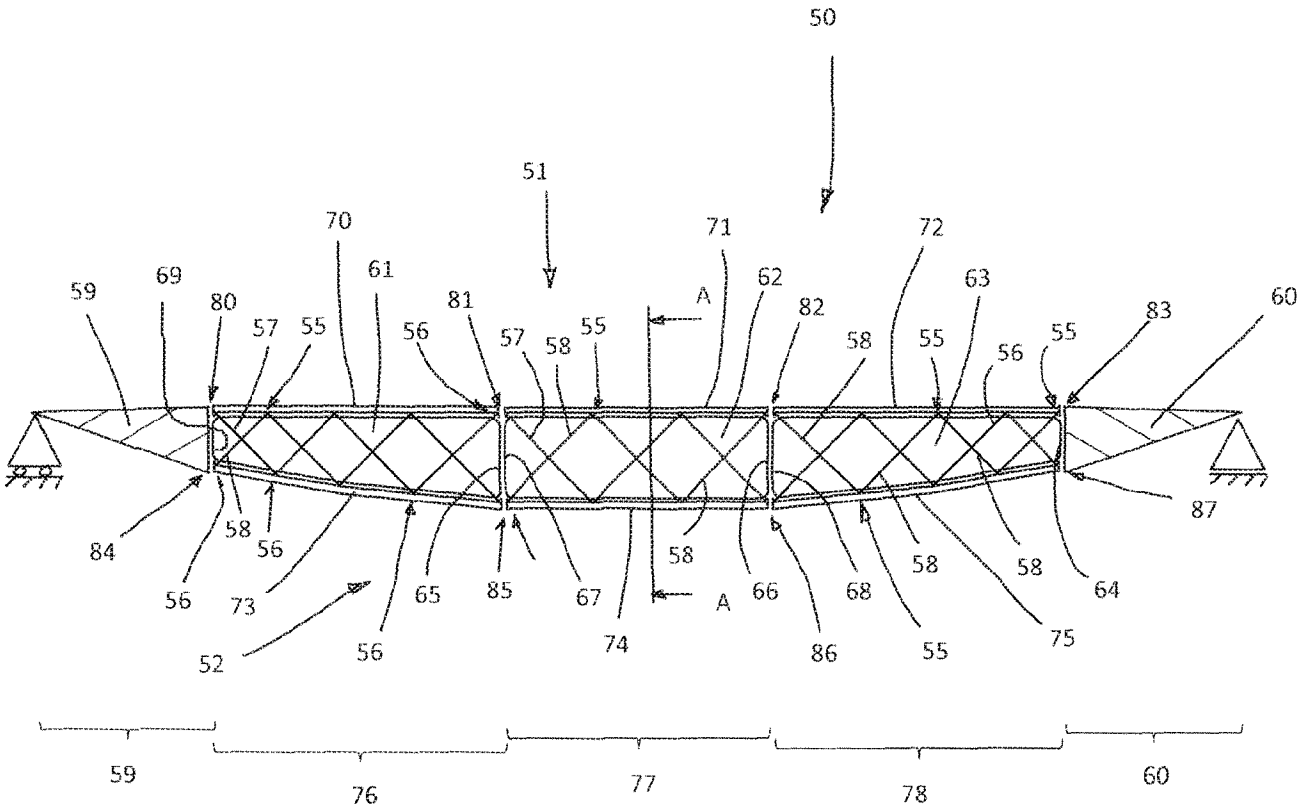
FIG. 6*a* shows a further embodiment, which is in particular suitable as a transportable bridge for vehicles, in a longitudinal section.

FIG. 6*a* shows a longitudinal section through a further embodiment of a support 50 according to the invention, which is constructed as a bridge. The support 50 is of spindle-shaped construction, with an essentially straight compression member 51 (beneficial with regards to the buckling load) and arcuate tension member 52. Two connection elements 57, 58 extend longitudinally through the support 50 from one end node 59 to the other end node 60, the sections thereof located between the connection points 55, 56 can also be constructed as tension rods. Three pneumatic pressure bodies 61 to 63 abut one another by way of a right face 65, 66 and a left face 67 to 68, whilst the right face 64 of the pressure body 63 and the left face 69 of the pressure body 61 do not abut the end nodes 59, 60.

The compression member 51 is composed of segments 70 to 72 that can be detached from one another, likewise the tension member 52, which has the segments 73 to 75. All segments 70 to 72 and 73 to 75 run over the length of the pressure member 61 to 63 assigned to them in each case, so that inherently stiff support modules 76 to 78 result in each case according to the invention (wherein the end-side support modules 76 and 78 can of course likewise be detached from the end nodes 59, 60 thereof).

The support 50 therefore has a plurality of, i.e. two, three or even more than the three support modules 76 to 78 shown by way of example in the figure, into which it can be dismantled or from which it can be assembled, which in turn brings advantages with regards to storage, transport and mounting and unmounting.

The individual modules are connected to one another in that the respective segments 70 to 72 of the compression member 55 and the respective segments 73 to 75 of the tension member 52 are fastened to one another in an operative manner by means of the connection points 80 to 87. This can take place by means of a simple screw connection or in a different way to be determined by the person skilled in the art, such as for example an articulation, which allows pivoting of the segments with respect to each other, but transmits compression and tensile forces. Likewise, the end-side modules 76, 78 are connected to the assigned end nodes 59, 60, wherein the end node 59 connects the assigned segments 70, 73 to one another by means of the connection points 80, 84 and the end node 60 connects the assigned segments 72, 75 by means of the connection points 83, 87 to one another in such a manner that the pressure forces acting in the compression member 51 and the tensile forces acting in the tension member 52 can be introduced into the respective other member 52, 51. In addition, the end nodes 59, 60 can also only be articulated by means of the connection points 80, 84 and 83, 87 at the associated segments 70, 73 and 72, 75.

As mentioned, in the mounted state, the pressure bodies 61 to 63 abut one another at the faces thereof, which creates the effect of a single, continuous pressure body.

A support 50, which is continuously stiff according to the invention results due to the secure connection of the segments 70 to 72 (compression member) and 73 to 75 (tension member) in the mounted state, the flexural stiffness of which support is not weakened by the modular construction compared to a support, which is not of modular construction. Preferably, the connection elements 57, 58 are then divided into sections in such a manner that they do not extend beyond one of the modules 76 to 78. Then, the corresponding two sections of the connection elements 57, 58 act at connection points 81, 82, 85, 86, which are assigned to two support modules 76, 77 or 77, 78 in each case. On the other hand, the connection elements can of course also be constructed continuously when using connection elements, or consist of a number of sections, which in each case reach only from one connection point to the other connection point.

In summary, it also results on the basis of the illustrated embodiment that the pneumatic support according to the invention can be constructed as a separate modular support module 76 to 78 (or that such support modules can be provided for the support according to the invention), which for its part can be connected to a further (such) support module 76 to 78 in such manner that these are fixed to one another and the connection points 80 to 87 of the compression members (in the figure: segments 70 to 72 of the united compression member 51) and the tension members (in the figure: segments 73 to 75 of the united tension member 52) at the same time form fastening points 55, 56 for the connection element. The compression members and the tension members of the support modules located at the end sides are connected to an end node, cf. the description of the end nodes 21, 22 of FIG. 3 in this regard.

In this case, in an embodiment of a pneumatic support, which is not illustrated in the figures, the support modules (76 to 78) are connected to one another in an articulated manner such that the support (20) can be folded up, wherein at one end of a stiff section, the compression member is articulated on the compression member of the adjacent stiff section, and at the other end of the stiff section, the tension member is articulated on the tension member of the other adjacent stiff section, and the respective other compression members and tension members of adjacent stiffer sections can be detachably connected to one another. One such pneumatic support cannot be disassembled into the support modules, but can nonetheless be folded up in a zigzag-like manner.

Figure 6B:
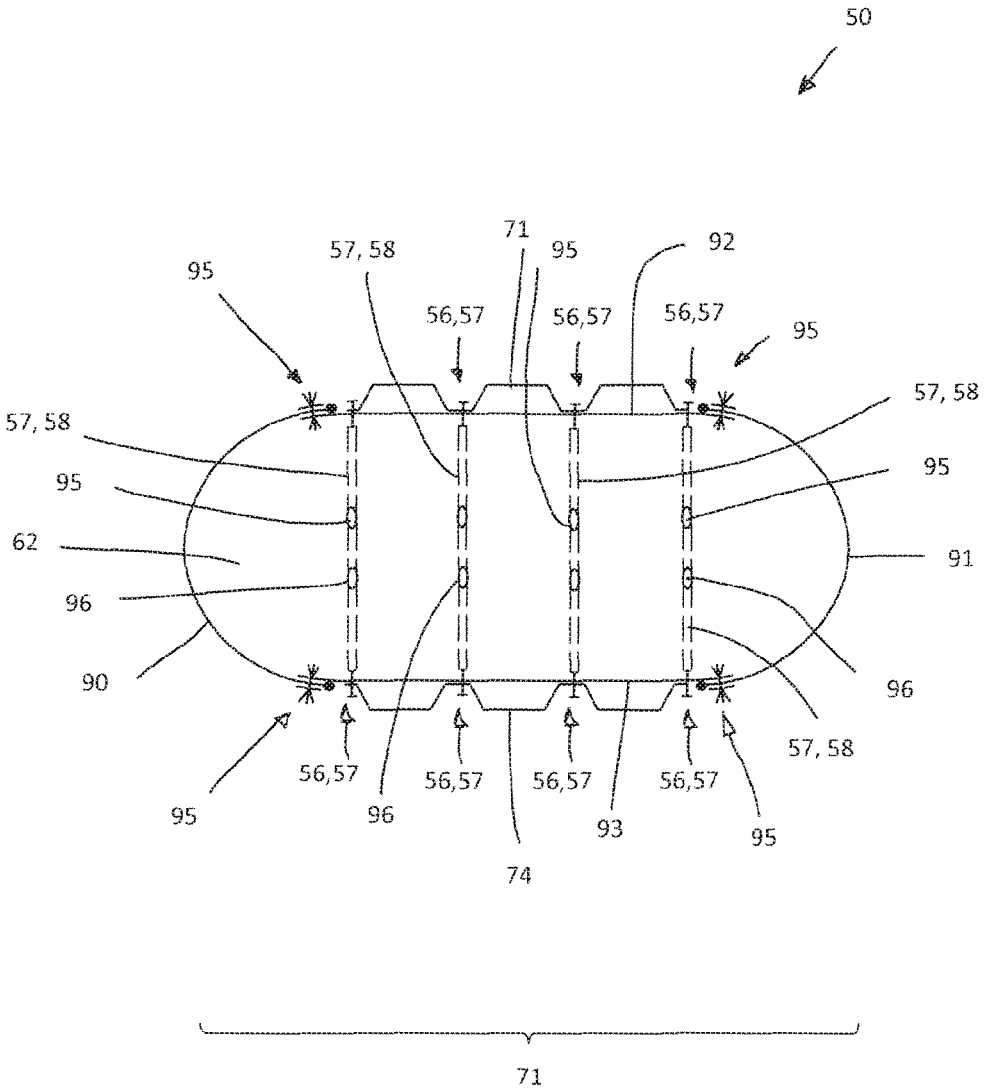
FIG. 6*b* shows a cross section at the location AA through the embodiment of FIG. 6*a*, FIG. 7 schematically shows the connection between the flexible and stiff parts of the embodiment according to FIG. 6*a*.

FIG. 6*b* shows a cross section through the support 50 of FIG. 6*a* in the plane AA of the support module 77. The pressure body 62, which is composed of the flexible side sections 90, 91 and the upper 92 and lower 93 sections and is at operating pressure, can be seen, wherein the upper and lower sections 92, 93 are here constructed stiffly, but elastically enough to be able to yield to the load deformations of the support 50, which are low according to the invention (but of course still present). The upper section 92 supports the segment 71 of the compression member 51, the lower section 93 supports the segment 74 of the tension member 52, which segments 71, 74 can for example be formed from a thin metal sheet and in this manner form a carriageway or at least a support for a suitable planking.

Figure 7:
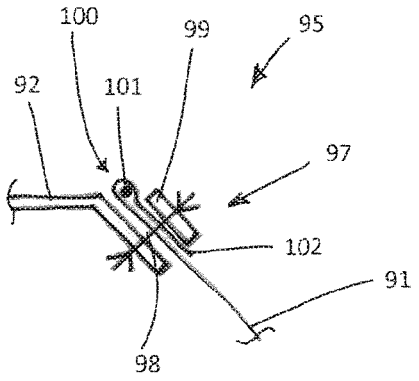

The connections 95 between the side sections 90, 91 and the upper and lower sections 92, 93 are gas-tight and illustrated in more detail in FIG. 7.

In the interior of the pressure body 62, four sets of connection elements 57, 58 run side by side, the course of which is indicated dashed and the points of intersection 95 (connection elements 57) and 96 (connection elements 58) of which with the plane AA can be seen.

The connection elements 57, 58 are fastened on the symbolically indicated connection points 56, 57, for example according to FIG. 5*a*.

It can be seen from the figure in particular that a plurality of sets of connection elements 57, 58 can be guided laterally next to one another, which makes it possible to construct an extra wide support 50. This is advantageous, if for example for a bridge, two mutually adjacent supports were to be provided, the intermediate space of which would have to be covered by means of planking: in the case of the support 50 with a cross section constructed as in FIG. 6*b*, the storage, transport and mounting outlay can advantageously be lowered with respect to a conventional construction with two supports.

It is preferably also possible that the person skilled in the art constructs the segments 70 to 72 and 73 to 75 (FIG. 6*a*) in a gas-tight manner, so that the upper 92 and lower 93 sections can be omitted, whereby the pressure bodies 61 to 63 then have the flexible edge sections 90, 91 and the (stiff) segments 70 to 72 and 73 to 75. Alternatively, the lower segments 73 to 75 of the tension member 52 can of course be constructed as ropes, which would then run fourfold next to one another in accordance with the exemplary embodiment shown in the figure, and would each be connected to an assigned set of connection elements 57, 58 in an operative manner.

FIG. 7 schematically shows the connection location 95 between the flexible edge section 91 and the upper section 92, wherein the flexible edge section is held by means of a clamping point 97. The clamping point 97 preferably has a symbolically indicated bolt 98, which fixes a counterplate 99 on the upper section 92 (which is stiff here). The longitudinal edge 100 of the flexible edge section 91 is thickened by means of an end section 102 of the flexible section 91, which is wrapped over a rope 101, and can therefore no longer slip back through the clamping point 97 and is therefore fixed in a gas-tight manner by the clamping. The person skilled in the art can construct all connection locations 95 in this manner or in a different suitable manner.

Figure 8A:
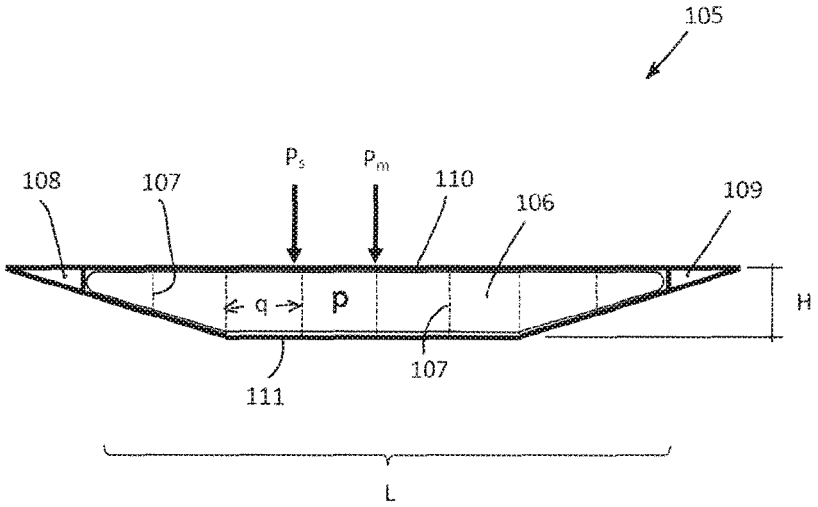
FIG. 8*a* shows the pneumatic support according to the prior art used for a comparative calculation.

FIG. 8*a* shows a support 105 according to the prior art, with a pressure body 106 and vertical tension members 107 running therein and arranged at a distance a from one another. End nodes 108, 109 connect a compression member 110 to a tension member 111 in an operative manner.

Figure 8B:
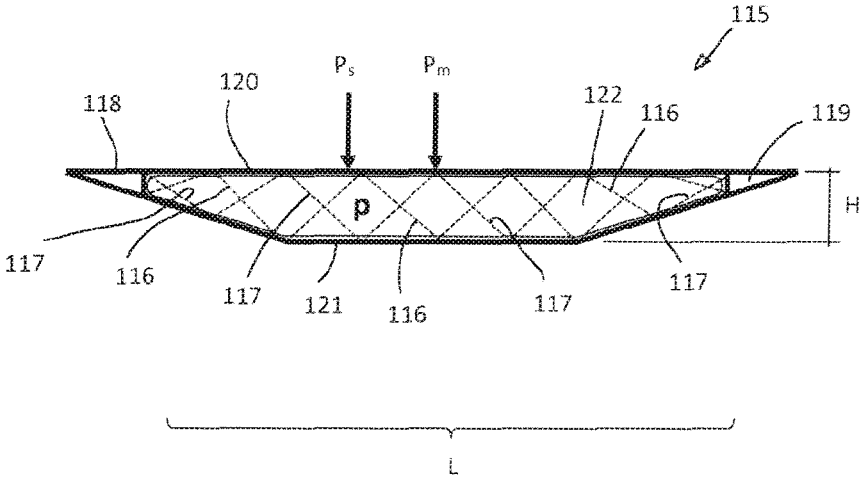
FIG. 8*b* shows the pneumatic support according to the present invention used for the comparative calculation.

FIG. 8*b* shows an embodiment of a support 115 according to the invention with a pressure body 122, which differs from the support 105 (FIG. 8*a*) by way of the connection members 116, 117 thereof, which run continuously in a zigzag-shaped manner. End nodes 118, 119 connect a compression member 120 to a tension member 121 in an operative manner.

A simulation of the applicant for the deformation of both supports 105, 115 once with a centrally acting load $P_m$ and then with a laterally acting load $P_s$ resulted in the deformations illustrated in the graphs of FIGS. 9*a* to 9*c*.

Both supports 105, 115 have the same dimensions for the comparative deformation calculation:

length L=20 m, height H=2 m, load $P_{m,s}$=200 kN, compression member 110, 120 and tension member 111, 121 made from, moment of inertia $I=2\times10^7$ $mm^4$ in each case, cross-sectional area F=7000 $mm^2$ in each case, width of compression member 110, 111 and tension member 111, 121 b=1.0 m in each case, internal pressure in pressure bodies 106, 122 p=50 $kN/m^2$, from which follows a vertical force onto the compression member 110, 120 and the tension member 111, 121 of q=pa=50 $kN/m^2$, cross-sectional area of the vertical tension members 107 and the connection members 116, 117 D=900 $mm^2$ in each case, and point of action for the load $P_m$ at a distance of 10 m and for the load $P_s$ at a distance of 6 m from the left end node 108 of the support 105, 115.

The numerical results for the calculated deformations 15 for $P_m$ are $$\delta_{UpperChordP} := \begin{array}{c}\text{Support 115}\\ \begin{pmatrix}0\\-7.6\\-10.1\\-15.5\\-16.6\\-21.3\\-16.6\\-15.5\\-10.1\\-7.6\\0\end{pmatrix}\end{array} \quad \delta_{LowerChordP} := \begin{array}{c}\text{Support 115}\\ \begin{pmatrix}0\\-7.7\\-13.8\\-14.6\\-19.9\\-19.3\\-19.9\\-14.6\\-13.8\\-7.7\\0\end{pmatrix}\end{array}$$

$$\delta_{UpperChordT} := \begin{array}{c}\text{Support 110}\\ \begin{pmatrix}0\\8.0\\10.2\\-14.8\\-71.8\\-107.0\\-71.8\\-14.8\\10.2\\8.0\\0\end{pmatrix}\end{array} \quad \delta_{LowerChordT} := \begin{array}{c}\text{Support 110}\\ \begin{pmatrix}0\\7.9\\9.4\\-15.2\\-72.8\\-107.0\\-72.8\\-15.2\\9.4\\7.9\\0\end{pmatrix}\end{array} \quad x := \begin{array}{c}\text{Position from left}\\ \begin{pmatrix}0\\2\\4\\6\\8\\10\\12\\14\\16\\18\\20\end{pmatrix}\end{array}$$

-continued $$\text{and for } P_s \quad \delta_{UpperChordP} := \begin{array}{c}\text{Support 115}\\ \begin{pmatrix}0\\-9.6\\-12.1\\-20.4\\-15.4\\-15.5\\-13.1\\-11.1\\-6.7\\-5.2\\0\end{pmatrix}\end{array} \quad \delta_{LowerChordP} := \begin{array}{c}\text{Support 115}\\ \begin{pmatrix}0\\-9.7\\-17.3\\-14.5\\-19.2\\-16.6\\-14.8\\-11.3\\-10.2\\-5.5\\0\end{pmatrix}\end{array}$$

$$\delta_{UpperChordT} := \begin{array}{c}\text{Support 110}\\ \begin{pmatrix}0\\-99.2\\-171.4\\-181.6\\-116.2\\-10.3\\94.4\\155.7\\144.3\\80\\0\end{pmatrix}\end{array} \quad \delta_{LowerChordT} := \begin{array}{c}\text{Support 110}\\ \begin{pmatrix}0\\-99.2\\-172.1\\-181.0\\-117.2\\-11.4\\93.4\\155.2\\143.6\\80\\0\end{pmatrix}\end{array}$$

Figure 9:
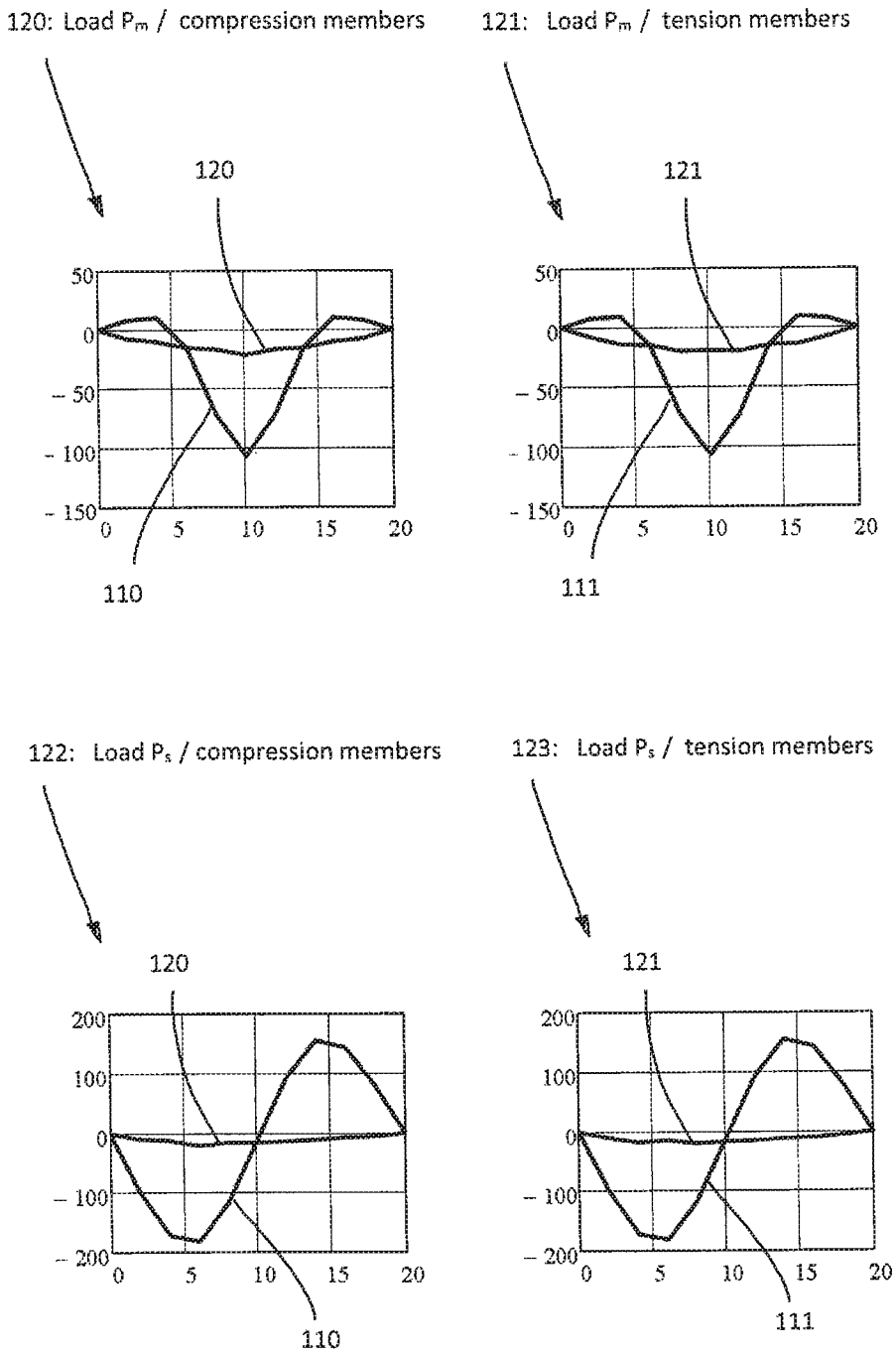
FIG. 9 shows four graphs with a comparison of the deformations of the compression member and the tension member between the pneumatic support according to the prior art and according to the present invention, one load acting symmetrically one time and one load acting asymmetrically one time on the respective support.

FIG. 9 shows the corresponding graphs 120 to 123 with the deformations $\vartheta$ of the supports 105, 115 on the basis of the deformation (bending line) of the compression members 110, 120 thereof or the tension members 120, 121 thereof, wherein the comparison takes place once for a centrally acting load $P_m$, cf. graphs 120 and 121 and then for an asymmetrically acting load $P_s$, cf. graphs 122 and 123. In this case, one graph either shows the bending line of the compression members 110, 120 (graphs 120 and 122) or the bending line of the tension members 111, 121 (graphs 121, 123).

Graph 120 shows the deformation of the compression members 110, 120 of the supports 105, 115 under the load $P_m$, wherein the compression member 110 of the support 105 according to the prior art is clearly displaced downwards by 107 mm at the location of the acting load $P_m$, but the compression member 120 of the support 115 according to the invention is only shifted by 21 mm. It is likewise possible to see how the compression member 110 of the support 105 according to the prior art warps upwards at the side, but the compression member 115 does not.

Graph 121 shows the deformation of the tension members 111, 121 for the centrally acting load $P_m$, wherein the deformation thereof is very similar to that of the compression members 110, 120 according to graph 120, which may be traced back to the effect of the tension members 107 arranged at a distance a.

Beyond the in each case very similar deformation of the compression and tension members of the two supports (prior art—invention), the massively reduced flexion is clear in the first place, which in the support 115 according to the invention makes up approx. 20% of that of the support 105 according to the prior art—which is a consequence of the arrangement according to the invention of the connection elements.

The graphs 122 and 123 show the deformation of the compression members 110, 120 and the tension members 111, 121 of the supports 105 (prior art) and 115 (according to the invention) on the basis of the laterally acting load $P_s$. As expected, the compression member 110 and the tension member 111 of the support 105 are strongly deformed, with a drop at the location of the load $P_s$ and warping in the other half of the support 105.

Surprisingly, the flexion of the compression member 111 and tension member 121 of the support 115 according to the invention is reduced even more strongly than in the case of the centrally acting load $P_m$: the deformation of the support 115 according to the invention is reduced from 181 mm (support 105 according to the prior art) to just 20 mm, i.e. to approx. 10%, in turn as a consequence of the arrangement according to the invention of the connection elements.

It can be seen from the graphs 120 to 123 that the support 115 according to the invention achieves the set object and in particular is substantially more flexurally stiff than the pneumatic support according to the prior art. This stiffening results over the stretch in which the connection members are guided through the support in an uninterrupted zigzag manner. In addition to the desired stiffening per se, this also means that the risk of buckling for the compression member 120 is reduced considerably, which considerably increases the loadability (or the safety factor thereof for a certain load) of the support 115 compared to the support 105 of the prior art.

As mentioned above, the compression member is located on the side of the load action on the pneumatic pressure body, and the tension member is located on the side facing away from the load action. Furthermore, a plurality of sets of connection elements can be arranged next to one another (FIG. 6*b*). It is however also possible, particularly for a load which is not always precisely balanced, to provide an additional compression member or an additional tension member, which likewise has fastening points for a connection element, and to provide a further connection element in a zigzag-shaped manner between this additional compression member or tension member and the single tension member or compression member. In contrast with FIG. 6*b*, the sets of connection elements are not parallel, but rather are inclined with respect to one another. In the arrangement according to FIG. 6*b*, the compression member 51 or tension member 52, which is constructed to be wide, can also be split into a plurality of compression members or tension members that run parallel to one another, so that as a result, a further compression member and a further tension member (to a first compression member or tension member) is additionally provided, with fastening points for a further connection element in each case, which extends between the further compression member and the further tension member along the same in a zigzag-shaped manner.

The invention claimed is:

1. A pneumatic support comprising:

a body which can be placed under pressure pneumatically, which at operating pressure keeps a compression member, which extends substantially over a length thereof, and a tension member, which likewise extends substantially over the length thereof, at a distance from one another in an operative manner;

connection points being provided on the compression member and on the tension member for at least one tensile connection element, which extends between the compression member and the tension member;

wherein the connection element extends between the compression member and the tension member in a zigzag-shaped manner over a plurality of connection points in each case both in a region of the compression member and in the region of the tension member;

and wherein the compression and the tension member are free of articulate joints.

2. The pneumatic support according to claim 1, wherein the at least one connection element extends continuously through the support, over an entire length of the region that can be placed under pressure.

3. The pneumatic support according to claim 1, wherein the connection element is divided into individual sections, which in each case extend from a fastening point on the compression member to an associated fastening point on the tension member.

4. The pneumatic support according to claim 1, wherein longitudinal axes of two connection elements acting at the same connection point essentially intersect in an interior of the compression member.

5. The pneumatic support according to claim 1, wherein longitudinal axes of two connection elements acting at the same connection point essentially intersect in an interior of the tension member.

6. The pneumatic support according to claim 1, wherein a plurality of connection members extending through the support in a zigzag-shaped manner are provided, wherein the same act at their own fastening points in each case.

7. The pneumatic support according to claim 1, wherein the sections of the at least one connecting member acting between two assigned fastening points are inclined essentially by 45° with respect to longitudinal axis of the support.

8. The pneumatic support according to claim 1, wherein the connection element or a section of the connection element is constructed as a flexible tension member, preferably as a rope.

9. The pneumatic support according to claim 1, wherein the tension member is constructed such that it can be loaded with pressure.

10. The pneumatic support according to claim 1, wherein a longitudinal axis thereof is curved in such a manner that the same is constructed in an arcuate manner.

11. The pneumatic support according to claim 1, wherein the same additionally has a compression member or a tension member with fastening points for a connection element, and a further connection element extends in a zigzag-shaped manner between this additional compression member or tension member and the single tension member or compression member.

12. The pneumatic support according to claim 1, wherein the same additionally has a further compression member and a further tension member each with fastening points for a further connection element which extends between the further compression member and the further tension member in a zigzag-shaped manner along the same.

13. The pneumatic support according to claim 1, wherein the same is constructed as a support module, which can be connected to a further support module in such a manner that the same are fixed to one another at faces and connection locations of the compression members and the tension members form fastening points for the connection element at the same time.

14. The pneumatic support according to claim 13, wherein the fastening points on the compression member and those on the tension member have a distance and are offset with respect to one another by half of the distance in each case, such that the connection element extends along the body in a regular zigzag line.

15. The pneumatic support according to claim 13, wherein the pneumatic support has a plurality of support modules.

16. The pneumatic support according to claim 15, wherein the support modules thereof are connected to one another in an articulated manner such that the support can be folded up, wherein at one end of a stiff section, the compression member is articulated on the compression member of an adjacent stiff section, and at the other end of the stiff section, the tension member is articulated on the tension member of the other adjacent stiff section, and respective other compression members and tension members of adjacent stiffer sections can be detachably connected to one another.

* * * * *